US006853303B2

(12) United States Patent
Chen et al.

(10) Patent No.: US 6,853,303 B2
(45) Date of Patent: Feb. 8, 2005

(54) RFID SYSTEM AND METHOD FOR ENSURING PERSONNEL SAFETY

(75) Inventors: Fung-Jou Chen, Appleton, WI (US); Walter C. Reade, Appleton, WI (US); Jeffrey Dean Lindsay, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 76 days.

(21) Appl. No.: 10/301,877

(22) Filed: Nov. 21, 2002

(65) Prior Publication Data

US 2004/0100384 A1 May 27, 2004

(51) Int. Cl.[7] ..... G08B 23/00
(52) U.S. Cl. ..... 340/573.1; 340/5.7; 340/572.1
(58) Field of Search ..... 340/573.1, 572.1, 340/679, 541, 5.2, 5.7; 235/375, 487

(56) References Cited

U.S. PATENT DOCUMENTS

| | | | | |
|---|---|---|---|---|
| 4,656,463 A | * | 4/1987 | Anders et al. | 340/573.4 |
| 5,047,614 A | | 9/1991 | Bianco | |
| 5,164,707 A | * | 11/1992 | Rasmussen et al. | 340/551 |
| 5,361,070 A | | 11/1994 | McEwan | |
| 5,380,991 A | | 1/1995 | Valencia et al. | |
| 5,677,927 A | | 10/1997 | Fullerton et al. | |
| 5,687,169 A | | 11/1997 | Fullerton | |
| 5,711,160 A | | 1/1998 | Namisniak et al. | |
| 5,727,153 A | | 3/1998 | Powell | |
| 5,798,694 A | | 8/1998 | Reber et al. | |
| 5,832,035 A | | 11/1998 | Fullerton | |
| 5,942,977 A | | 8/1999 | Palmer et al. | |
| 5,955,969 A | | 9/1999 | D'Hont | |
| 5,990,794 A | | 11/1999 | Alicot et al. | |
| 6,037,879 A | | 3/2000 | Tuttle | |
| 6,177,903 B1 | | 1/2001 | Fullerton et al. | |
| 6,195,006 B1 | | 2/2001 | Bowers et al. | |
| 6,218,979 B1 | | 4/2001 | Barnes et al. | |
| 6,226,619 B1 | | 5/2001 | Halperin et al. | |
| 6,249,227 B1 | | 6/2001 | Brady et al. | |
| 6,294,997 B1 | | 9/2001 | Paratore et al. | |
| 6,354,493 B1 | | 3/2002 | Mon | |
| 6,386,450 B1 | | 5/2002 | Ogasawara | |
| 6,407,665 B2 | | 6/2002 | Maloney | |
| 6,429,768 B1 | | 8/2002 | Flick | |
| 6,435,407 B1 | | 8/2002 | Fiordelisi | |
| 6,446,049 B1 | | 9/2002 | Janning et al. | |
| 6,451,154 B1 | | 9/2002 | Grabau et al. | |
| 6,491,217 B2 | | 12/2002 | Catan | |

(List continued on next page.)

FOREIGN PATENT DOCUMENTS

| | | |
|---|---|---|
| DE | 29714999 | 11/1997 |
| DE | 19742126 | 3/1999 |
| WO | 0065532 | 11/2000 |
| WO | 0169429 | 9/2001 |
| WO | 0215073 A1 | 2/2002 |
| WO | WO 02/15073 | 2/2002 |
| WO | 0248955 A1 | 6/2002 |
| WO | WO 02/080060 | 10/2002 |

OTHER PUBLICATIONS

Advertisement—www.mobilecloak.com—mCloak—RFID Tolltags etc., Copyrighted—2002.

(List continued on next page.)

*Primary Examiner*—Thomas Mullen
(74) *Attorney, Agent, or Firm*—Dority & Manning

(57) ABSTRACT

A RFID method and system are provided for ensuring that personnel are properly outfitted with necessary equipment for performance of a particular task or procedure. RFID smart tags are configured with the required pieces of equipment, the smart tags containing information to identify their respective pieces of equipment. A RFID scanner is disposed at a location through which an individual passes prior to performance of the procedure. The scanner interrogates the smart tags and determines if the individual has all of the required pieces of equipment.

35 Claims, 3 Drawing Sheets

U.S. PATENT DOCUMENTS

| | | | |
|---|---|---|---|
| 6,507,279 | B2 | 1/2003 | Loof |
| 6,693,511 | B1 | 2/2004 | Seal |
| 6,693,539 | B2 | 2/2004 | Bowers et al. |
| 6,707,376 | B1 | 3/2004 | Patterson et al. |
| 6,707,381 | B1 | 3/2004 | Maloney |
| 2002/0040321 | A1 | 4/2002 | Nicholson |
| 2002/0070862 | A1 | 6/2002 | Francis et al. |

OTHER PUBLICATIONS

Advertisement—www.mobilecloak.com—RFID Tags, Copyrighted—2002.

Ultra–Wideband Technology for Short– or Medium–Range Wireless Communications, Copyrighted—2001 Intel Corporation.

Ultra Wideband: The Ultimate Disruptive Technology, www.ultrawidebandplanet.com—Jun. 11, 2002—Int Media Group.

U.S. Approves Ultra–Wideband Technology, www.wireless-newsfactor.com—Feb. 15, 2002.

New Public Safety Applications and Broadband Internet Access Among Uses Envisioned by FCC Authorization of Ultra–Wideband Technology, Federal Communications Commission—Feb. 14, 2002.

Ultra Wideband—Searchnetworking.com, Copyrighted 2000–2002—Techtarget.

Internet Article—www.timedomain.com –PulsON Technology Capabilities, Sep. 3, 2002.

White Paper—Integration of Auto–ID Tagging System with Holonic Manufacturing Systems—Cambridge University Auto–ID Center, Published—Sep. 1, 2001.

Auburn University—Detection & Food Safety Center—AUDFS.eng.auburn.edu, Sep. 4, 2002.

Internet Article—Smart Tags Indicate Freshness—courses.she.umn.edu, Sep. 4, 2002.

Internet Article—www.aimglobal.org—Pharmaceutical Distributor Cuts Day of Safety Stock, Aug. 29, 2002.

Internet Article www.idtechex.com—Independent Market, Strategic and Technology Reports, Aug. 29, 2002.

Internet Article—www.readymealsinfo.com—M&S Pilots RFID System for Fresh Food Operation, Sep. 4, 2002.

Internet Article—AUDFS.eng.auburn.edu—Auburn University Detection & Food Safety Center, Sep. 4, 2002.

RFID Journal—Internet Article—www.rfidjournal.com—Auto–ID Center Opens Demonstration Lab in the U.K., Sep. 4, 2002.

Internet Article—www.autoidcenter.org—Transmitting ePC Codes, Aug. 26, 2002.

Internet Article—www.electronicidinc.com—DestronFearing Electronic ID Background, Sep. 4, 2002.

Internet Article—Destronfearing.com—Applications–Companion Animals, Sep. 4, 2002.

Internet Article—AUDFS.eng.auburn.edu—Auburn University—Detection & Food Safety Center, Sep. 4, 2002.

Internet Article—SFGate.com—Shops Try Chips for Tracking Every Move by Client 'Tribe' Monitoring Systems Note What Catches Customers' Eyes, Aug. 6, 2002.

Internet Article—www.aimglobal.org—Radio Frequency Identification—RFID a Basic Primer, Sep. 29, 1999.

Internet Article—www.aimglobal.com—Common Applications—RFID, Jul. 23, 2002.

Internet Article—www.usatoday.com—New Chips Could Make Everyday Items 'Talk', Jul. 23, 2002.

Forbes Magazine—The Internt of Things, Mar. 18, 2002.

Auto–ID Center—Institute for Manufacturing, University of Cambridge—White Paper—Auto–ID Based Control—An Overview, Feb. 1, 2002.

Wireless Handhelds—Beam up Some Information, Scotty, Control Engineering, May, 2002.

Scientific American—Wireless Data Blaster, May, 2002.

Auto–ID Center, Institute for Manufacturing, University of Cambridge, White Paper—The Intelligent Product Driven Supply Chain, Feb. 1, 2002.

Auto–ID Center Massachusetts Institute of Technology—White Paper—Smart Medicine—The Application of Auto–ID Technology to Healthcare, Feb. 1, 2002.

U.S. Appl. No. 10/301,513, filed Nov. 21, 2002.

U.S. Appl. No. 10/301,879, filed Nov. 21, 2002.

U.S. Appl. No. 10/301,882, filed Nov. 21, 2002.

U.S. Appl. No. 10/301,846, filed Nov. 21, 2002.

U.S. Appl. No. 10/301,883, filed Nov. 21, 2002.

U.S. Appl. No. 10/301,549, filed Nov. 21, 2002.

"Theory, History, and the Advancement of Parametric Loudspeakers: A Technology Overview", by James J. Croft and Joseph O. Norris, Revision D, American Technology Corporation, San Diego, CA 2002. Available at http://www.atcs-d.com/pdf/HSSWHTPAPERRevE.pdf.

Popular Science, What's New, Suzanne Kantra Kirschner, We've heard hypersonic sound. It could change everything. Exemplary applications of hypersonic technology are illustrated at www.popsci.com/popsci/hometech/article/0,12543,351353,00.html.

D. McFarlane, "Auto–ID Based Control," White Paper for the Auto–ID Centre Institute for Manufacturing, University of Cambridge, Cambridge, United Kingdom, Feb. 1, 2002. Available at http//www.autoidcenter.org/research/CAM–AUTOID–WH–004.pdf.

Chien Yaw Wong, "Integration of Auto–ID Tagging System with Holonic Manufacturing Systems," White Paper for the Auto–ID Centre Institute for Manufacturing, University of Cambridge, Cambridge, United Kingdom, Sep. 2001. Available at www.autoidcenter.org/research/CAM–WH–001.pdf.

Wincor Nixdorf, Member of METRO Group, Future Store Initiative, "Store Vision—High–Tech fo r the Future in Retail," Wincor Vision May 2, 2003. Available at http:/www.wincor–nixdor.com/internet/com/Idustries/Retail/WincorVision/WincorVisionSpezialIFSI,templated=blob.jsp.property=Data.pdf.

M&S Pilots RFID System For Fresh Food Operation . . . , Ready Meals info, Press Releases Nov. 20, 2001 2:30:23 PM http://www.readymealsinfo.com/resources/results.asp?txtContent=3459.

RFID Journal, Found at: http:216.121.131.129/article/articleprint/22/–1/1/Auto–ID Center Opens Demo Lab The center today opened a robotic demonstration lab at its facility in Cambridge, England, to show off RFID's manufacturing capabilities. Jul. 11, 2002 http://www.rfidjournal.com/article/articleprint/22/–1/1.

Electronic ID, Inc., Destron–Fearing Applications—Companion Animals http://www.destronfearing.com/elect/compan.html.

Ariana Eunjung Cha, Washington Post, Monday, Jun. 24, 2002, SFGate.com, Shops try chips for tracking every move by client 'tribe' Monitoring systems note what catches customers' eyes, URL: sfgate,com/article,cgi?file=/c/a/2002/06/24/BUI47064,DTL http://www..sfgate.com/cgi-?bin/article.cgi?file=/c/a/2002/06/24/BU147064.DTL&type=pri . . . .

Kevin Maney, USA TODAY, New chips could make everyday items 'talk' Apr. 11, 2002—Updated 10:34 PM ET www.usatoday.com http://www.usatoday.com/tech/news/2002/04/12/tinyband.htm.

Forbes.com—Magazine Article, Chana R. Schoenberger The internet of things, Mar. 18, 2002 http://www.forbes.com/global/2002/0318/092_print.html.

Ali Ahmad Zaharudin, Chien Yaw Wong, Vivek Agarwal, Duncan McFarlane, Robin Koh, Yun Y. Kang, "The Intelligent Product Driven Supply Chain," White Paper for the Auto–ID Centre Institute for Manufacturing, University of Cambridge, Cambridge, United Kingdom, Published Feb. 1, 2002. Distribution restricted to Sponsors until May 1, 2002. Available at www.autoidcenter.org/research/cam–wh–005.pdf.

David L. Brock, "Smart Medicine The Application of Auto–ID Technology to Healthcare," White Paper for the Auto–ID Center Massachusetts Institute of Technology, Cambridge, MA, USA, Published Feb. 1, 2002. Distribution restricted to Sponsors until May 1, 2002. Available at www.autoidcenter.org/research/mit–autoid–wh–010.pdf.

AMSKAN Editorials, RFID Overview: The Science of evaluating RFID (Radio Frequency Identification) Technology, AMSKAN Update: Jan. 1999. Available at www.amskan.com/html/rfid_overview.html.

Ludwig Weimann and Junru Wu Transdermal Drug Delivery by Sono–Macroporation http://ultra–sonictechnologies.com/cancun–presentation.htm Nov. 4, 2003 11:28:14 AM.

* cited by examiner

RFID SYSTEM AND METHOD FOR ENSURING PERSONNEL SAFETY

TECHNICAL FIELD OF THE INVENTION

The present invention relates generally to the field of personnel safety, and more particularly to a system and method for ensuring the safety of personnel in areas requiring protective gear, clothing, and the like.

BACKGROUND

Radio Frequency Identification Devices (RFIDs) are low-cost, passive "smart" chips or "tags" that can be embedded in or attached to articles, products, and the like, to convey information about the product via a scanner. The smart tags are generally small labels or the like with a miniature embedded antenna. The tags may be passive or active, the active tags requiring an internal power supply. A reader or scanner interrogates the smart tag with an electronic "trigger" signal. The tag in turn generates an electromagnetic pulses response that is readable by the scanner, the response containing the product information. RFID smart tags can be embedded in or attached to product packaging, or incorporated directly into the product, and may convey conventional "bar code" information, as well as other more detailed information.

Various commercial applications have been suggested for smart tags, particularly in the area of retail marketing and sales. For example, RFID technology may be used to gather information related to consumer trends, purchasing habits, consumption rates, etc. It has also been suggested that RFID technology has promise in the areas of inventory control, manufacturing process and control, product accountability and tracking systems, etc. Manufacturers, shippers, and retailers may be able to follow a given product through their respective systems from initial production through to point of sale. It has been suggested that other applications may include shopping carts that automatically charge a bank account, refrigerators that tap into the Internet to automatically reorder items that are running low, and interactive televisions linked to such refrigerators that will feed targeted commercials and special offers to consumers. (See, "They Know What You Eat," by Kayte VanScoy, Smart Business, January 2001).

The present invention relates to a novel implementation of RFID technology for enhancing the safety of personnel involved in procedures requiring special protective gear, clothing, and the like.

There are any number of conceivable work environments wherein personnel are required to wear protective clothing or articles. For example, personnel involved in the nuclear industry must wear radiation protective clothing, personal dosimetry devices, and so forth. Law enforcement personnel are required to wear protective vests, helmets, etc., in any number of situations. There are numerous situations in the medical field wherein healthcare workers should wear protective gowns, masks, face shields, gloves, etc. Workers in the food service industry are required to wear hair netting, gloves, masks, etc., in various situations. There are also many industrial manufacturing scenarios wherein personnel are required to wear protective or other specially designed articles in order to ensure a "clean" environment. For example, personnel in the micro-electronics manufacturing industry, biotech industry, laboratory/testing industry, etc., are required to wear such articles to not only ensure their own safety, but to protect the equipment and devices which they assemble or perform various operations with.

Presently, there does not exist an automated process or system for ensuring that personnel wear the required articles and adhere to safety precautions regarding protective gear, clothing, and the like. It is commonplace for individuals to simply forget certain items, particularly in highly stressful situations. It is generally up to the individual, or a supervising individual, to ensure that such articles are worn by visual inspection. There are obvious drawbacks to this rudimentary system.

The present invention provides a RFID system and methodology for ensuring compliance with the requirement for special gear, clothing, protective devices, and the like, in any manner of work environment.

SUMMARY

Objects and advantages of the invention will be set forth in the following description, or may be obvious from the description, or may be learned through practice of the invention.

A methodology and system according to the invention involves, in general aspects, the incorporation of identification smart tags with protective articles, such as protective clothing, eyewear, vests, fade masks, assisted breathing devices, and the like. It should be appreciated that the invention is not limited to any particular category or type of protective article. Thus, the term "equipment", "necessary equipment", or "protective article" is meant to encompass any device or piece of apparel that is required to be worn or donned by an individual prior to performing a particular work procedure. The type of procedure or work environment is also not a limiting factor to the invention, as will be set forth in greater detail below.

The method and system according to the invention for ensuring that personnel are properly outfitted with necessary equipment for the performance of a procedure includes identifying the equipment that an individual is required to have to perform the procedure. A smart tag is configured with the identified equipment. For example, the smart tag may be permanently adhered to the equipment, sewn into an article of clothing, included as an integral component of a piece of safety equipment, and the like. The smart tag contains information that at least identifies the respective piece of equipment it is configured with. For example, a smart tag may be attached to the frame of a pair of safety goggles. The smart tag contains information sufficient to convey that it is associated with a pair of safety goggles. The smart tag may contain or be associated with additional information regarding its respective associated piece of equipment, such as an individual serial number or a product ID number to distinguish the piece of equipment from similar pieces of equipment, information regarding maintenance performed on the equipment or maintenance required to be performed, information regarding the last use of the equipment, information regarding an expiration date or useful lifetime of the equipment, etc. Such information may also be present in a database and may be associated with the smart tag via an identification code in the smart tag, which may serve as pointer or link to the database information.

A smart tag scanner may be disposed at a location through which an individual must pass prior to the performance of a particular procedure. The smart tag scanner is configured to retrieve the equipment identification information from the smart tags as the individual passes through the location. An accountability check is conducted of the required equipment with the actual equipment identified by the smart tag scanner. The scanner may initiate any number of responses in the event that the individual is missing a piece of necessary equipment. For example, the scanner may initiate an audible or visual alarm. The scanner may incorporate a visual display that identifies the missing piece of equipment. The scanner may initiate a signal to a remote station, such as a personnel office, security office, safety office, etc.

It should be appreciated that the system and methodology according to the invention are not limited to any particular type of "location." For example, the location may be the entrance to a controlled laboratory area, medical facility, manufacturing facility, and the like. In this scenario, the scanner is disposed at a location to scan the individual prior to the individual entering the sensitive or controlled area. The scanner may be interfaced with an automatic locking gate or door at the entrance such that the gate or door only open upon a determination that the individual has all of the necessary equipment.

In an alternate embodiment, the scanner may be disposed at the exit of a given location. For example, a hospital locker/dressing room area, firehouse locker room, operating room prep area, military installation ready room, and the like. In these scenarios the procedure or task to be performed by the individual is beyond or outside of the controlled area, and the system ensures that the individual has the required necessary equipment prior to leaving the area. For example, the system may be incorporated in a firehouse dressing area to ensure that firemen or other rescue personnel are properly equipped prior to leaving the station.

In an alternate embodiment, a smart tag is associated with the individual and contains information identifying the individual. In this manner, particular individuals are identified by the scanner at the accountability location. With this embodiment, an electronically stored database may include particular equipment requirements for different individuals. The smart tag scanner includes this database, or is in communication with a computer having the database, such that an individual's particular equipment requirement list is called up by the system upon identification of the individual. The equipment accountability check is then conducted against this called-up requirement list. The database may store the particular equipment profiles for a plurality of individuals. The plurality of individuals may all have different equipment requirements. In some cases, the individual may not be approved for the use of certain equipment or may require additional approval from a supervisor before being allowed access to an area or item of equipment, and the safety system may make and enforce this determination based upon information associated with the individual and the safety demands of the area.

With another embodiment of the system and methodology of the invention, the scanner is linked to a remote database that may be accessed to obtain additional information about the individual or the respective scanned pieces of equipment. For example, the smart tag information may contain a URL code to provide access an Internet website having the additional information. Alternatively, the scanner may access a secure computer network system or other internal database architecture/structure.

Additional aspects of the present methodology and system will be described below with reference to the figures.

DETAILED DESCRIPTION

Figure 1:
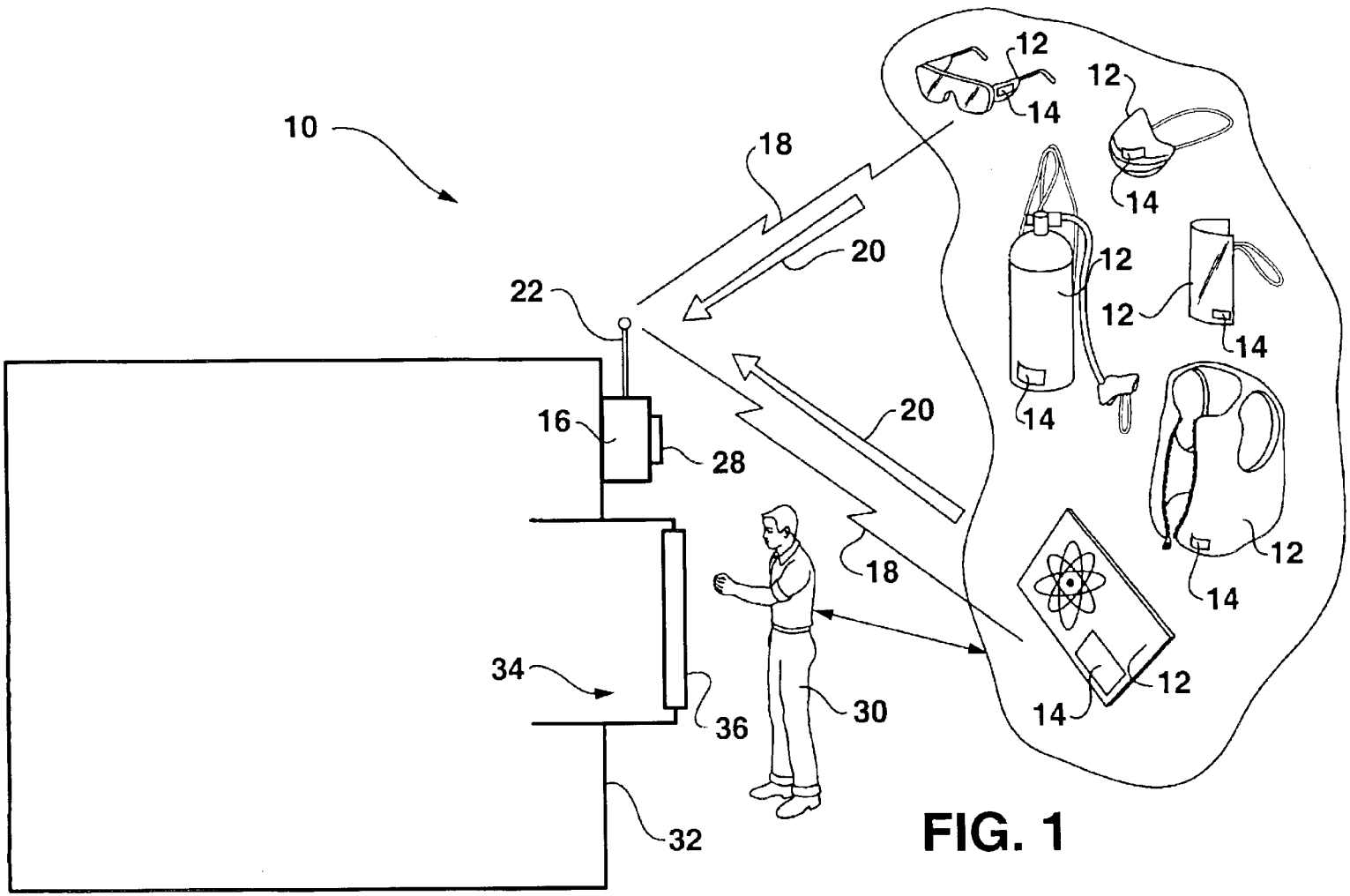
FIG. 1 is a graphic illustration of concepts according to a method and system of the invention.

Reference will now be made in detail to one or more embodiments of the invention, examples of which are graphically illustrated in the drawings. Each example and embodiment are provided by way of explanation of the invention, and not meant as a limitation of the invention. For example, features illustrated or described as part of one embodiment may be utilized with another embodiment to yield still a further embodiment. It is intended that the present invention include these and other modifications and variations.

FIG. 1 graphically illustrates conceptual aspects of a method and system 10 according to the invention. Any type or variation of equipment 12 that is required to be worn or donned by an individual 30 prior to performing a particular task or work function is provided with a smart tag 14. It should be appreciated that the invention is not limited to any particular category or type of equipment 12, but generally encompasses all types of safety gear, protective clothing, assisted breathing devices, and virtually any device or article that is placed on or about an individual's body for ensuring the safety of the individual or equipment. For example, in FIG. 1 safety glasses, a face mask, a protective vest, a gas tank/mask breathing apparatus, a face shield, and a radiation dosimetry device are all illustrated as exemplary embodiments of necessary equipment for performing particular functions. The type of task or function to be performed by the individual 30 will dictate the particular pieces of necessary equipment 12. FIG. 1 is meant to conceptually convey this idea, and is not a limitation of the invention. As discussed in greater detail below, the smart tags 14 transmit a pulse of coded equipment information 20 in response to an electronic "trigger" signal 18 from a scanner 16. The scanner includes an antenna 22 for transmitting the trigger signal 18 and receiving the pulsed equipment information signal 20. The smart tags 14 may be attached, adhered, or otherwise associated with the respective pieces of equipment 12 by any suitable means, including adhesives, mechanical fasteners, and the like. In particular embodiments, the smart tags 14 may be incorporated as integral components of the equipment. Alternatively, the smart tags 14 may be provided as separate components, such as adhesive labels or tags, which are attached to the pieces of equipment.

A smart tag scanner 16 is disposed at a location through which the individual 30 must pass prior to performance of the procedure at issue. The smart tag scanner 16 is configured to retrieve the equipment identification information from the smart tags 14, as discussed in greater detail below. In FIG. 1, the location through which the individual passes is graphically illustrated as the entrance 34 to a controlled or sensitive area 32. The controlled area 32 may be any physical location wherein a procedure is performed requiring protective gear clothing, or the like. For example, the controlled area 32 may be a laboratory, medical facility, industrial site, and so forth. It should also be appreciated that the controlled area need not be physically defined within a building or structure. For example, the controlled area 32 may be the site of an emergency, such as a crime scene, fire, accident, etc. In such situations, it is often required that the attending individuals 30 wear protective gear or clothing of one sort or the other. The location or gate 32 may simply be a temporary or portable type of structure, similar to a security checkpoint or metal detector scanner used at airports, and the like.

As the individual 30 passes through the entrance 34, the pieces of equipment 12 having the smart tags 14 incorporated therewith come within range of the scanner 16. With conventional RFID "smart" systems, the smart tags 14 are passive devices and the scanner 16 emits the trigger excitation signal 18 received by an internal antenna in the smart tags 14. This signal 18 causes the smart tags 14 to generate and transmit an electromagnetic pulse containing the coded equipment identifying information signal 20. The coded signal 20 is received by the receiver antenna 22 and decoded. An accountability check is then conducted wherein the scanned equipment pieces 12 are checked against a list of required pieces of equipment.

In the event that the individual 30 does not have all of the required pieces of equipment, the scanner 16 may include or activate any type of audible alarm 28 or visual alarm 26. Alternatively, the scanner 16 may be in communication with a remotely disposed alarm.

An audible alarm 28 may be transmitted by one or more loudspeakers to allow the individual and others to hear the alarm, or the audible alarm 28 may be directed exclusively to the individual. For example, narrow beams of sound may be projected to the individual using hypersonics sound technology, such as that provided by American Technology (San Diego, Calif.). Principles of hypersonic sound systems are described in a white paper entitled, "Theory, History, and the Advancement of Parametric Loudspeakers: A Technology Overview," by James J. Croft and Joseph O. Norris, Revision D, American Technology Corporation, San Diego, Calif., 2002, available at http://www.atcsd.com/pdf/HSSWHTPAPERRevD.pdf. Exemplary applications of hypersonic technology are illustrated at http://www.popsci.com/popsci/hometech/article/0,12543,351353,00.html.

It may be desired that the scanner 16 be operationally interfaced with an automatic gate or door 36, particularly with the gate's control mechanism 38. The gate 36 remains locked and is only opened upon the scanner 16 determining that the individual 30 has all of the required pieces of equipment 12 to enter into the controlled area 32. Any configuration of automatic security gate or door may be utilized in this regard.

RFID smart tag technology is known and understood by those skilled in the art, and a detailed explanation thereof is not necessary for purposes of describing the method and system according to the present invention. Generally, conductive or passive smart tags 14 consist of silicon, a coiled, etched, or stamped antennae, a capacitor, and a substrate on which the components are mounted or embedded. A protective covering is typically used to encapsulate and seal the substrate. Inductive or passive smart tags have been introduced by Motorola under the name "BiStatix". A detailed description of the BiStatix device may be found in U.S. Pat. No. 6,259,367 B1, incorporated herein by reference in its entirety for all purposes. Another commercial source of suitable smart tags is Alien Technology Corporation of Morgan Hill, Calif., under the technology name FSA (Fluidic Self-Assembly). With the FSA process, tiny semiconductor devices are assembled into rolls of flexible plastic. The resulting "smart" substrate can be attached or embedded in a variety of surfaces. The smart tag technology under development at the Auto-ID Center at Massachusetts Institute of Technology (Cambridge, Mass.) can also be used within the scope of the present invention. Further information on smart tags and related technology is disclosed in U.S. Pat. No. 6,451,154, "RFID Manufacturing Concepts," issued Sep. 17, 2002 to Grabau et al.; U.S. Pat. No. 6,354,493, "System and Method for Finding a Specific RFID Tagged Article Located in a Plurality of RFID Tagged Articles," issued Mar. 12, 2002 to Mon; PCT publication WO 02/48955, published Jun. 20, 2002; U.S. Pat. No. 6,362,738, "Reader for Use in a Radio Frequency Identification System and Method," issued Mar. 26, 2002 to Vega; D. McFarlane, "Auto-ID Based Control," White Paper for the Auto-ID Centre Institute for Manufacturing, University of Cambridge, Cambridge, United Kingdom, Feb. 1, 2002, available at http://www.autoidcenter.org/research/CAM-AUTOID-WH-004.pdf; and Chien Yaw Wong, "Integration of Auto-ID Tagging System with Holonic Manufacturing Systems," White Paper for the Auto-ID Centre Institute for Manufacturing, University of Cambridge, Cambridge, United Kingdom, Sep. 2001, available at www.autoidcenter.org/research/CAM-WH-001.pdf.

Other RFID technologies believed to be of value for the present invention include those produced by Microchip Technologies (Chandler, Ariz.), which provides remote read-write chips at several frequencies. Also of potential value are the I*CODE chips and readers of Philips Semiconductor (Eindhoven, The Netherlands), which, in one embodiment, are said to include 384 bit configurable read/write memory with 64 bits for a unique serial number (e.g., an electronic product code). Sokymat (Lausanne, Switzerland) markets the PICCOLO read-only RFID disc tag which transmits data to a reader station by an AM radio signal. The tag is said to have 64 bits of data that can be programmed during manufacturer by laser fusing of polysilicon links in order to store a unique code on each tag.

Texas Instruments (Dallas, Tex.) offers RFID technology as part of Texas Instruments RFID (TI*RFID™) Systems, formerly known as the TIRIS© system (Texas Instruments Registration and Identification System), which is used to track and identify various assets using devices such as the TI Tag It™ chip.

Gemplus (Gemenos, France) provides smart tags (sometimes called "smart labels") and smart cards employing RFID technology, which may be used as smart tags. They also market interfaces, antennas, scanners and software that can be adapted for use with smart tags.

Nedap (Groenlo, The Netherlands) provides smart cards and a 13.56 MHz smart tag using RFID technology with 512 bits of read-write memory with a range of about 120 cm. It is claimed that about 20 such tags per second can be read successfully by a scanner.

Checkpoint Systems Inc. (Miami, Fla.) offers a smart tag with WORM technology (write once, read many). One example is the MCRF355 chip, described more fully at http://www.idsystems.com/reader/1999_05/join0599.htm.

PDA-like reader systems and other portable readers for RFID technology are marketed by Omron Company (Tokyo, Japan), such as the Model V700 or V720 series.

High frequency bands can be used in RFID technology, such as bands between 300 MHz and 10 GHz. SCS Corporation (Rancho Bernardo, Calif.), for example, markets smart tag technology at 2.45 GHz. Ultra-wide band technology can also be adapted for RFID systems.

A related technology within the scope of the present invention is Surface Acoustic Wave (SAW) technology. For example, InfoRay (Cambridge, Mass.) markets a passive smart tag that is said to achieve long ranges (up to 30 meters) using a Surface Acoustic Wave (SAW) device. On a chip coupled with an antenna. The SAW device converts a radio signal to an acoustic wave, modulates it with an ID code, then transforms it to another radio signal that is emitted by the smart tag and read by a scanner. The ID code of the smart tag is extracted from the radio signal. The scanner is said to compare the spectral content of the signal with a database of signatures and to derive the ID code. This method enables a read range of up to 30 m (typical 10–20 m). The system can operate in the 915 MHz band and 2.45 GHz band. RFSAW, Inc. (Dallas, Tex.) also provides minute Surface Acoustic Wave (SAW) RFID devices that can be used within the scope of the present invention.

The antenna embedded within the smart tags 14 is typically a useful component of the device, though it is recognized that alternatives to antennas may exist in some applications. (For example, for some metallic objects, the smart tag need not comprise an antenna but the metallic object itself can serve as the antenna.) The excitation signal 18 from the scanner 16 is received by the antenna to "activate" the smart tag. The received excitation signal 18 is the power source for the smart tag 14 and results in the generation of the electromagnetic pulse containing the coded food product information signal 20. A detailed description of RFID smart tag antennas may be found in U.S. Pat. No. 6,320,556 B1, incorporated herein by reference for all purposes.

In an alternate embodiment, the smart tags 14 may be active devices. In this configuration, the smart tag 14 includes active transceiving circuitry that has the capability to selectively respond to coded request signals transmitted by a scanner 16. The active smart tag 14 may include the capability to receive and store additional information beyond the information contained in its fixed code. An active smart tag 14 requires an internal power supply, such as a micro-battery, thin film battery, or the like.

An embodiment of the system and method 10 according to the invention may include individual smart tags assigned or otherwise associated with each individual 30. These personnel smart tags contain information identifying the respective individuals 30. Thus, when an individual 30 comes within range of the scanner 16, the individual's smart tag 30 is activated and that particular individual is identified. The individual's identity may then be used for verifying that any individual-specific requirements as to equipment, protective clothing, articles, and the like, is satisfied. For example, the scanner 16 may include or be in communication with a computer having an electronically stored profile that is particular for each individual 30. This profile may include the necessary equipment pieces that are required by that respective individual. Upon the individual being identified, the profile is called up and the equipment accountability check is conducted against the profile. The system may include an electronic library or database containing a plurality of individual specific profiles. This system may be particularly useful wherein a number of individuals perform different tasks requiring different pieces of equipment. For example, the different medical personnel within an operating room may require different types of gowns, face masks, surgical gloves, face shields, etc., depending on their responsibility in the operating room. Likewise, individuals in a controlled laboratory will have different equipment requirements depending on their particular assigned task.

The smart tags 14 may contain additional information regarding the respective pieces of equipment 12 that is retrieved by the smart tag scanner and processed to determine if the equipment 12 satisfies particular criteria. For example, the smart tags 14 may contain information regarding the useful dates or expiration dates for any type of equipment 12. In another embodiment, the smart tags 14 may contain information regarding maintenance required or performed on the equipment. For example, a gas regulator or mask associated with an assisted breathing device requires periodic maintenance and safety checks. The smart tags associated with these devices may be active tags wherein the dates and type of maintenance performed may be entered into the tags. Upon an individual 30 donning the apparatus in an emergency situation, it may be automatically determined if the equipment 12 is actually safe for use. In an alternative embodiment, the smart tags 14 may contain information regarding the history of the piece of equipment 12, for example, the number of times it has been worn or used in a particular situation, and the like.

Figure 3:
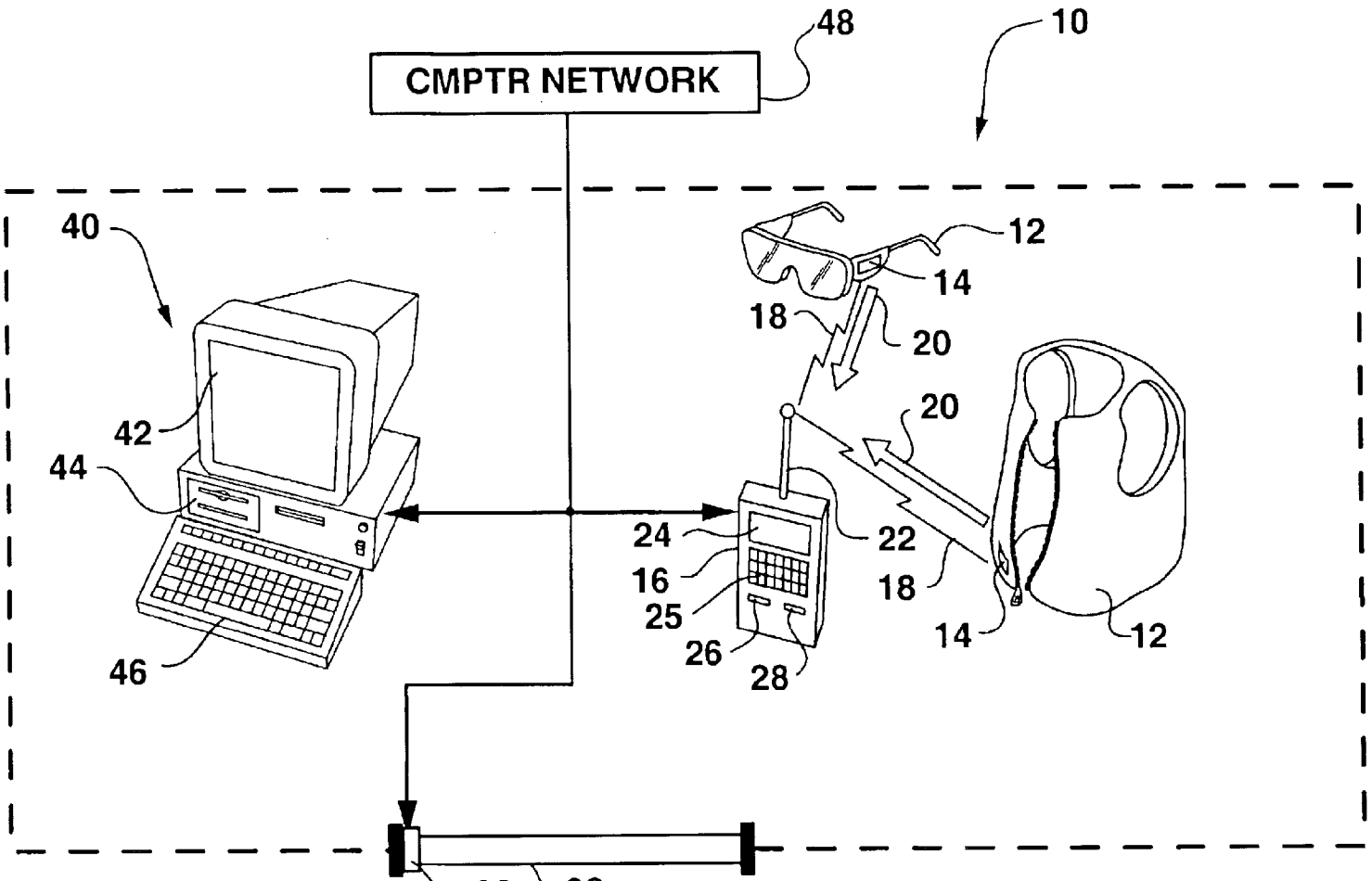
FIG. 3 is a graphic illustration of yet another embodiment of the method and system according to the invention.

The equipment identifying signal 30 may include a link or code to a remote database having additional equipment information. This link or code may enable the scanner 16 to communicate with such database by conventional wireless or wired technology. For example, referring to FIG. 3, the scanner 16 may be in communication with a computer system 40 having a monitor 42, CPU 44, and keyboard 46 and having access to an internal or external computer network 48. The system 40 may also be Internet accessible. The signal 20 may include an URL code to launch an Internet browser application. In this way, the scanner 16 or computer 40 may provide the individual 30 or other remote individuals with Internet access to websites containing additional information about the equipment. The scanner 16 may be an Internet accessible wireless device, such as a PDA (Personal Data Assistant) device. The scanner 16 may include a visual display screen 24 and a keypad 25 for interactive communication with the remote database or Internet. The Internet websites may be maintained, for example, by manufacturers, suppliers, or vendors of the equipment. The RFID scanner 16 may be of conventional hardware and software architecture. The scanner 16 receives the coded equipment information signal 20, and the decodes the signal into usable commands and data. The scanner 16 includes a microprocessor and software programs for this purpose. The scanner 16 provides an output to the individual 30 that may be in various forms. For example, the scanner 16 may visually display the identified pieces of equipment 12 by way of a visual display screen 24. Alternatively, the scanner 16 may include any configuration of visible alarm 26 or audible alarm 28 to automatically alert the individual 30 if a necessary piece of equipment 12 is missing. The alarms may be sent to remote locations as well.

Figure 2:
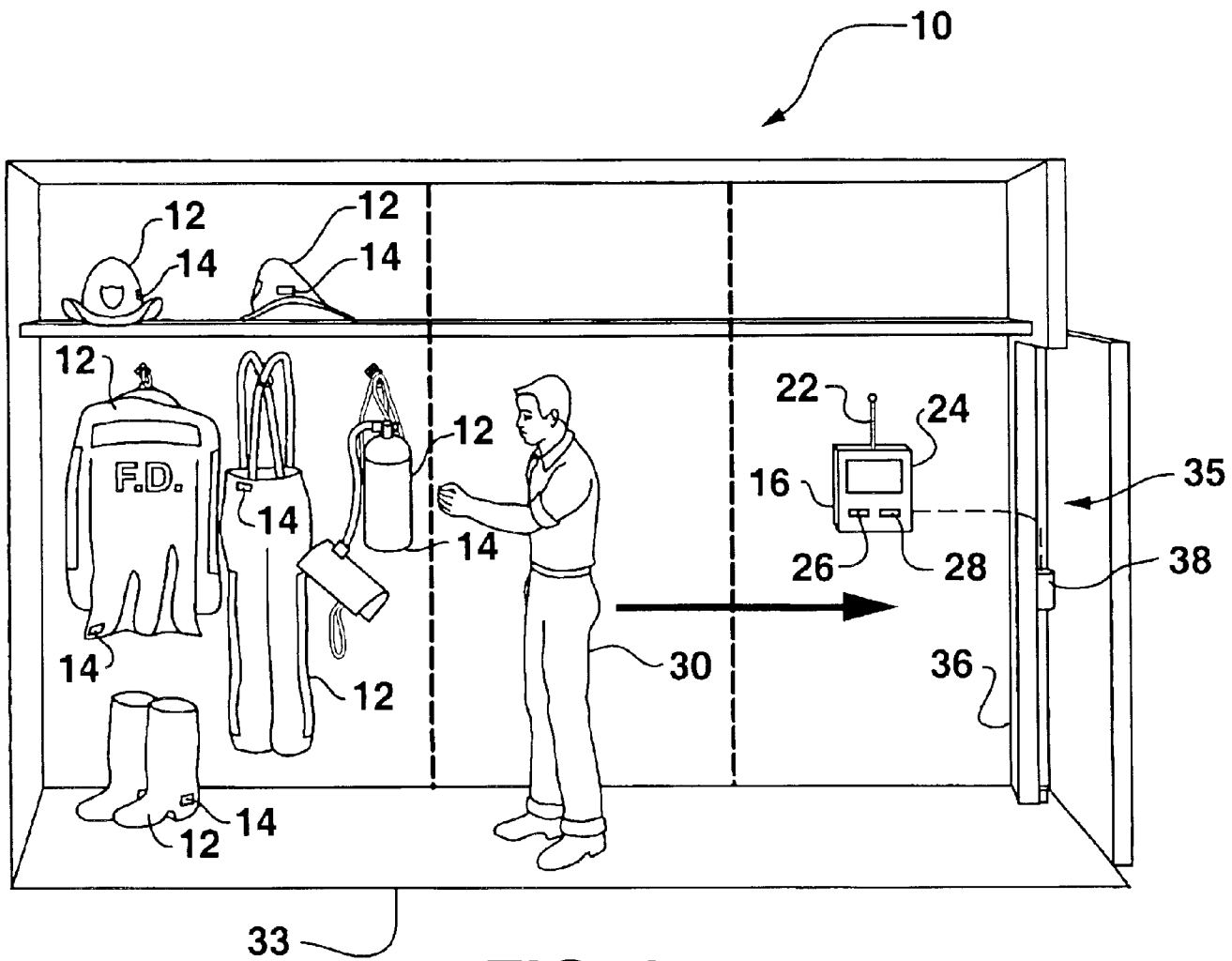
FIG. 2 is a graphic illustration of an alternate method and system according to the invention.

FIG. 2 is a graphic illustration of an alternate conceptual use of the system 10 according to the invention. In this scenario, the scanner 16 is disposed in a storage location of the equipment 12 and associated smart tags 14. For example, in the illustrated embodiment, the storage location 33 is a locker room or prep room for firefighters or other emergency response personnel. The location 33 may also be a prep room for a medical facility, industrial site, or the like. In general, the individual 30 dons the required equipment 12 prior to leaving the location 33 through an exit passage 35. The exit passage 35 may be a gated passage wherein the controller 38 of a gate 36 is interfaced with the scanner 16. The individual 30 is allowed to exit the location 33 upon verification that the individual 30 has donned all of the required equipment 12. The benefits of this arrangement in emergency response situations are readily apparent.

It should be appreciated by those skilled in the art that the system and method according to the invention have wide applications, and that the examples and embodiments set forth herein are merely exemplary. It is intended that the present invention include such uses and embodiments as come within the scope and spirit of the appended claims.

What is claimed is:

1. A method for ensuring that personnel are properly outfitted with necessary equipment for the performance of particular procedures, said method comprising:

for a given procedure, identifying the equipment that an individual is required to have for performing a procedure;

configuring a smart tag with the identified equipment, the smart tag containing information to identify the equipment it is configured with;

locating a smart tag scanner at a location through which the individual must pass prior to performance of the procedure, the smart tag scanner configured to retrieve the equipment identification information from the smart tags;

conducting an accountability check of the required equipment against the actual equipment identified by the smart tag scanner; and comprising denying passage for the individual through the location having the smart tag scanner if the individual is lacking a piece of the required equipment.

2. The method as in claim 1, wherein the smart tag scanner is disposed at a security check-point.

3. The method as in claim 1, wherein the smart tag scanner is disposed at a gate facility.

4. The method as in claim 3, wherein the gate facility includes a gate that is interlocked with the smart tag scanner so as to open only upon the individual having the required equipment.

5. The method as in claim 1 wherein the required equipment includes protective clothing or devices.

6. The method as in claim 1, wherein the smart tags are permanently affixed to the pieces of equipment.

7. A method for ensuring that personnel are properly outfitted with necessary equipment for the performance of particular procedures, said method comprising:

for a given procedure, identifying the equipment that an individual is required to have for performing a procedure;

configuring a smart tag with the identified equipment, the smart tag containing information to identify the equipment it is configured with;

locating a smart tag scanner at a location through which the individual must pass prior to performance of the procedure, the smart tag scanner configured to retrieve the equipment identification information from the smart tags;

conducting an accountability check of the required equipment against the actual equipment identified by the smart tag scanner; and comprising displaying the identification of the pieces of equipment identified by the smart tag scanner to the individual.

8. The method as in claim 7, comprising initiating an alarm in the event that the individual does not have all of the required equipment.

9. The method as in claim 7, comprising associating a smart tag with the individual, the smart tag containing information identifying the individual.

10. The method as in claim 9, comprising electronically storing a respective individual's particular equipment requirement profile at the smart tag scanner, calling up the individual's profile upon identification of the individual with the smart tag scanner, and conducting the accountability check against the profile.

11. The method as in claim 10, comprising electronically storing respective profiles for a plurality of individuals.

12. The method as in claim 11, wherein the plurality of individuals have different equipment requirements.

13. A method for ensuring that personnel are properly outfitted with necessary equipment for the performance of particular procedures, said method comprising:

for a given procedure, identifying the equipment that an individual is required to have for performing a procedure;

configuring a smart tag with the identified equipment, the smart tag containing information to identify the equipment it is configured with;

locating a smart tag scanner at a location through which the individual must pass prior to performance of the procedure, the smart tag scanner configured to retrieve the equipment identification information from the smart tags;

conducting an accountability check of the required equipment against the actual equipment identified by the smart tag scanner; and wherein the smart tags contain additional information regarding their respective pieces of equipment that is retrieved by the smart tag scanner and processed to determine if the equipment satisfies particular criteria.

14. The method as in claim 13, wherein the smart tags contain information regarding useful dates or expiration dates of the equipment.

15. The method as in claim 13, wherein the smart tags contain information regarding maintenance required or performed on the equipment.

16. The method as in claim 13, wherein the smart tags contain information regarding history of the equipment.

17. A method for ensuring that personnel are properly outfitted with necessary equipment for the performance of particular procedures, said method comprising:

for a given procedure, identifying the equipment that an individual is required to have for performing a procedure;

configuring a smart tag with the identified equipment, the smart tag containing information to identify the equipment it is configured with;

locating a smart tag scanner at a location through which the individual must pass prior to performance of the procedure, the smart tag scanner configured to retrieve the equipment identification information from the smart tags;

conducting an accountability check of the required equipment against the actual equipment identified by the smart tag scanner; and wherein the equipment smart tag information includes a link to a remote database having information regarding the equipment.

18. The method as in claim 17, wherein the scanner accesses the remote database and displays information therefrom.

19. The method as in claim 17, wherein the remote database is an Internet site, the scanner being an Internet accessible device.

20. The method as in claim 19, wherein the Internet site is maintained by a manufacturer of the equipment.

21. A system for ensuring that personnel are properly outfitted with necessary equipment for the performance of particular procedures, said system comprising:

predefined equipment pieces that an individual is required to have to perform a procedure;

at least one smart tag configured with each equipment piece, said smart tag containing information to identify said respective piece of equipment it is configured with;

a smart tag scanner disposed at a location through which the individual must pass prior to performance of the procedure, said smart tag scanner configured to retrieve the equipment identification information from said smart tags and conduct an accountability check of said scanned equipment against a stored list of required equipment for the particular procedure to be performed; and wherein said location through which the individual passes comprises a gated entry, said gated entry operationally interfaced with said smart tag scanner so as to open only upon the individual having the required equipment as scanned by said smart tag scanner.

22. The system as in claim 21, wherein said equipment pieces comprise protective clothing or devices.

23. The system as in claim 21, wherein said scanner is configured with a visual display, said visual display displaying said equipment pieces identified by said scanner.

24. The system as in claim 21, further comprising an alarm.

25. The system as in claim 21, further comprising a smart tag associated with the individual, said individual's smart tag containing information identifying the individual.

26. The system as in claim 25, comprising an electronically stored profile of a respective individual's particular equipment requirement, said scanner calling up said profile upon identification of the individual by said smart tag scanner, and conducting said accountability check against the profile.

27. The system as in claim 26, comprising electronically stored profiles for a plurality of individuals, wherein the plurality of individuals have different equipment requirements.

28. The system as in claim 21, wherein said smart tags are permanently affixed to said equipment pieces.

29. A system for ensuring that personnel are properly outfitted with necessary equipment for the performance of particular procedures, said system comprising:

predefined equipment pieces that an individual is required to have to perform a procedure;

at least one smart tag configured with each equipment piece, said smart tag containing information to identify said respective piece of equipment it is configured with;

a smart tag scanner disposed at a location through which the individual must pass prior to performance of the procedure, said smart tag scanner configured to retrieve the equipment identification information from said smart tags and conduct an accountability check of said scanned equipment against a stored list of required equipment for the particular procedure to be performed; and wherein said location through which the individual passes comprises a security check-point.

30. A system for ensuring that personnel are properly outfitted with necessary equipment for the performance of particular procedures, said system comprising:

predefined equipment pieces that an individual is required to have to perform a procedure;

at least one smart tag configured with each equipment piece, said smart tag containing information to identify said respective piece of equipment it is configured with;

a smart tag scanner disposed at a location through which the individual must pass prior to performance of the procedure, said smart tag scanner configured to retrieve the equipment identification information from said smart tags and conduct an accountability check of said scanned equipment against a stored list of required equipment for the particular procedure to be performed; and wherein said smart tags contain additional information regarding their respective said pieces of equipment, said additional information relating to particular standards or requirements for said equipment pieces.

31. The system as in claim 30, wherein said additional information relates to expiration dates of the equipment.

32. The system as in claim 30, wherein said additional information relates to maintenance required or performed on the equipment.

33. A system for ensuring that personnel are properly outfitted with necessary equipment for the performance of particular procedures, said system comprising:

predefined equipment pieces that an individual is required to have to perform a procedure;

at least one smart tag configured with each equipment piece, said smart tag containing information to identify said respective piece of equipment it is configured with;

a smart tag scanner disposed at a location through which the individual must pass prior to performance of the procedure, said smart tag scanner configured to retrieve the equipment identification information from said smart tags and conduct an accountability check of said scanned equipment against a stored list of required equipment for the particular procedure to be performed; and wherein said equipment smart tag information includes a link to a remote database having information regarding said equipment.

34. The system as in claim 33, wherein said scanner accesses said remote database and displays information therefrom.

35. The system as in claim 34, wherein said remote database is an Internet site, said scanner being an Internet accessible device.

* * * * *